US007168381B2

(12) United States Patent
Cobb et al.

(10) Patent No.: US 7,168,381 B2
(45) Date of Patent: Jan. 30, 2007

(54) VESSEL HULL AND METHOD FOR CRUISING AT A HIGH FROUDE NUMBER

(75) Inventors: Bruce Cobb, Fremont, CA (US); Terrence W. Schmidt, Santa Clara, CA (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 11/447,341

(22) Filed: Jun. 5, 2006

(65) Prior Publication Data

US 2006/0254487 A1 Nov. 16, 2006

Related U.S. Application Data

(63) Continuation-in-part of application No. 10/712,986, filed on Nov. 12, 2003, now Pat. No. 7,055,446.

(60) Provisional application No. 60/426,070, filed on Nov. 12, 2002.

(51) Int. Cl.
*B63B 1/00* (2006.01)

(52) U.S. Cl. ..... 114/61.2; 114/61.26

(58) Field of Classification Search ..... 114/61.2, 114/61.26

See application file for complete search history.

(56) References Cited

U.S. PATENT DOCUMENTS

| | | | | |
|---|---|---|---|---|
| 3,304,899 | A | 2/1967 | Goodhue | |
| 5,134,950 | A | 8/1992 | Berte | |
| 5,320,056 | A | 6/1994 | Marinzoli | |
| 5,592,895 | A | 1/1997 | Schmidt | |
| 5,787,828 | A | 8/1998 | Barbier et al. | |
| 5,794,558 | A | 8/1998 | Loui | |
| 6,487,982 | B2 | 12/2002 | Takahashi et al. | |
| 6,666,160 | B1 | 12/2003 | Orneblad | |
| 7,055,446 | B2 * | 6/2006 | Cobb et al. | 114/61.2 |
| 2004/0112268 | A1 * | 6/2004 | Maloney et al. | 114/288 |
| 2004/0149196 | A1 * | 8/2004 | Schmidt et al. | 114/121 |

* cited by examiner

*Primary Examiner*—Stephen Avila
(74) *Attorney, Agent, or Firm*—Mark A. Wurm; Graybeal Jackson Haley LLP

(57) ABSTRACT

In one aspect of the invention, a vessel has a liquid-plane greater than one meter$^2$/(metric ton)$^{2/3}$ and includes a hull having a total length and a plurality of hull portions each having a length that is less than the total length. Each hull portion buoys the vessel. Each hull portion also protrudes above the liquid-line and includes a wetted area that does not contact the wetted areas of other hull portions when the boat accelerates through Froude numbers between 0.4 and 0.6. In addition, each hull portion includes a cross-sectional area having a perimeter defined by the edge of the wetted area and having an area defined by a plane that intersects the hull portion at the perimeter. The vessel's liquid-plane is the sum of each hull portion's cross-sectional area divided by the cube root of the square of the weight of the boat is at least one. When the vessel accelerates toward a cruising speed, the wetted area of each hull portion does not contact the wetted areas of the other hull portions, the vessel's hull experiences the maximum wave resistance at a lower speed than, and a maximum total resistance that is less than, a long, single hull providing the same buoyancy. Thus, the amount of power required to overcome the hump region and to cruise at a speed that generates a Froude number greater than 0.6 is less than conventional vessels having similar lengths and payload capacities.

30 Claims, 7 Drawing Sheets

RESISTANCE
17b
17a
18a
18b
15
15
16
16
SPEED

TOTAL RESISTANCE
19d
19c
19b
19a
19a
19c
SPEED

POWER
21d
21c
21b
21a
23
25b
25a
SPEED

VESSEL HULL AND METHOD FOR CRUISING AT A HIGH FROUDE NUMBER

CROSS REFERENCE TO RELATED APPLICATION AND CLAIM OF PRIORITY

This application is a Continuation-in-Part application from currently pending U.S. patent application Ser. No. 10/712,986, filed 12 Nov. 2003, now U.S. Pat. No. 7,055,446 issued Jun. 6, 2006, titled HIGH-FROUDE HULL SHIP, which is incorporated by reference; and claims priority from U.S. Provisional Application Ser. No. 60/426,070, filed on Nov. 12, 2002, which is also incorporated by reference.

BACKGROUND

A vessel that travels across the surface of a liquid, for example a ship on an ocean or a boat on a lake, experiences resistance—drag—that opposes its movement across the liquid. This resistance has many different components that are each generated from a different source. For example, the viscosity of the liquid that contacts the vessel's hull as the hull moves relative to the liquid generates a viscous resistance component that is directly proportional to $v^2$, which is the square of the vessel's speed. Another resistance component is generated by the vessel's hull pushing the liquid aside, and thus creating a wave, as the hull moves relative to the liquid. This wave resistance component represents energy that is absorbed by the liquid to generate the wave. Therefore, to move the vessel across the surface of the liquid, the vessel must be provided enough power to overcome the total resistance that the vessel experiences. If a resistance component is reduced, then the total resistance decreases, and thus less power will be required to move the vessel.

FIG. 1 is a typical graph of speed versus wave resistance and viscous resistance for two similar hulls whose only significant difference is their length. The contour 15 illustrates the general relationship between wave resistance and speed for the shorter hull. The contour 16 illustrates the general relationship between wave resistance and speed for the longer hull. The contour 17*a* illustrates the relationship between viscous resistance and speed for the shorter hull. The contour 17*b* illustrates the relationship between viscous resistance and speed for the longer hull.

As shown in FIG. 1, the maximum wave resistances 18*a* and 18*b* are close in magnitude, and the viscous resistances 17*a* and 17*b* increase as the speed of the hull increases and are also close in magnitude. In addition, and as discussed in greater detail in conjunction with FIGS. 2C and 2D, the maximum wave resistance 18*a* for the shorter hull occurs at a speed that is less than the speed at which the maximum wave resistance 18*b* occurs for the longer hull.

FIG. 2A is a typical graph of total resistance versus speed for the two hulls referenced in FIG. 1. The contour 19*a* illustrates the general relationship for the shorter hull, and is generated by adding the resistance value in each of the contours 15 and 17 of FIG. 1 that correspond to the same speed. The region 19*b* of the contour 19*a* corresponds to the total resistance when the maximum wave resistance 18*a* (FIG. 1) occurs. The contour 19*c* illustrates the general relationship for the longer hull, and is generated by adding the resistance value in each of the contours 16 and 17 of FIG. 1 that correspond to the same speed. The region 19*d* of the contour 19*c* corresponds to the total resistance when the maximum wave resistance 18*b* (FIG. 1) occurs.

FIG. 2B is a typical graph of power versus speed for the two hulls referenced in FIGS. 1 and 2A. The contour 21*a* illustrates the general relationship between speed and the amount of power required to maintain the speed for the shorter hull. The region 21*b* of the contour 21*a* corresponds to the amount of power at the speed that the shorter hull generates a maximum wave resistance 18*a* (FIG. 1). The contour 21*c* illustrates the general relationship between speed and the amount power required to maintain the speed for the longer hull. The region 21*d* of the contour 21*c* corresponds to the amount of power at the speed that the longer hull generates a maximum wave resistance 18*b* (FIG. 1). Power is related to total resistance and speed, and can be expressed by the mathematical relationship:

$$P = \frac{(R \times v)}{550}$$

where P=power in horsepower, R=resistance in pounds, and v=speed in feet/second.

As shown in FIG. 2B at slow speeds, speeds slower than the speed 23, the shorter hull requires more power to maintain its speed than the longer hull requires to maintain the same speed. But at fast speeds, speeds faster than the speed 23, the shorter hull requires less power to maintain its speed than the longer hull requires to maintain the same speed. Furthermore, the shorter hull requires less power to accelerate through its maximum-wave-resistance speed 25*a* than the longer hull requires to accelerate through its maximum-wave-resistance speed 25*b* because the total resistance and the speed 25*a* are significantly less than the total resistance and the speed 25*b*.

For any hull shape, the speed at which the hull experiences a maximum wave resistance can be estimated by calculating the Froude number. The Froude number F is a measure of the hull's velocity through the liquid relative to the hull's length, and is mathematically defined as follows:

$$F = \frac{v}{\sqrt{gl}}$$

where F=Froude number, v=hull speed relative to the liquid, g=acceleration of gravity, and l=hull length. The Froude number is unitless, and thus the units of v, g, and l are selected such that the square root of g multiplied by l produces the same unit as v. As shown in the equation, the Froude number is inversely proportional to the square root of the hull's length, and directly proportional to the hull's speed relative to the liquid.

FIG. 2C is a typical graph of wave resistance (Rw) versus Froude number for a hull moving in water, and illustrates the general relationship between wave resistance and Froude number. The length of the hull and the acceleration of gravity is the same for each Froude number in the graph. Thus, each Froude number corresponds to the hull's velocity relative to the liquid. Every moving hull has a unique graph that represents the relationship between the wave resistance that the hull experiences and the Froude number that the hull generates. Although the specific contour of the relationship (the graph) may vary from one hull to another, the general contour of the relationship is similar for most hulls. For example, every contour includes three regions, a low Froude number region 20 where the Froude number is less than 0.4, a hump region 22 where the Froude number is within the range 0.4 to 0.6, and a high Froude number region 24 where the Froude number is greater than 0.6.

As shown in FIG. 2C, when a hull's velocity generates a Froude number in the low Froude number region 20, the wave resistance is relatively low. Increasing the velocity of the hull to other Froude numbers in this Froude number region will proportionally and moderately increase the wave resistance that the hull experiences. When the hull's velocity generates a Froude number of approximately 0.4, increasing the hull's velocity, exponentially increases the wave resistance that the hull experiences. When the hull's velocity generates a Froude number near 0.5, the hull experiences the maximum wave resistance 26. This maximum 26 occurs when the wavelength of the wave generated by the hull is approximately equal to two times the length of the hull, and is often referred to as the resistance or powering "hump". But when the hull's velocity generates a Froude number greater than approximately 0.5, the wave resistance begins to decrease, and the hull experiences less wave resistance causing a further increase in the hull's velocity until the other components of drag, such as viscous drag, sufficiently increase to stop the hull's acceleration.

FIG. 2D is a typical graph of wave resistance (Rw) versus speed for two similar hulls whose only significant difference is their length. The graph illustrates the general relationship between the maximum wave resistance and the speed that the maximum wave resistance occurs. The relationship between wave resistance and speed for the shorter hull is shown by the contour 28. The relationship for the longer hull is shown by the contour 30. The maximum wave resistance for each 32 and 34 occurs at a speed that generates a Froude number of approximately 0.5.

As shown in FIG. 2D, the shorter hull's maximum wave resistance 32 occurs at a speed slower than the speed at which the longer hull's maximum wave resistance 34 occurs. Due to the shorter hull's larger cross-sectional area, which is required to provide a displacement that is equal to the longer hull's displacement, the shorter hull's maximum wave resistance 32 may also be greater than the longer hull's maximum wave resistance 34. Because the maximum wave resistance for most hulls occurs when the speed of the hull generates a Froude number approximately 0.5, the speed at which the hull experiences the maximum wave resistance depends on the length of the hull. Therefore, as the length of the hull increases, the speed at which the hull experiences the maximum wave resistance also increases. And as the length of the hull decreases, the speed at which the hull experiences the maximum wave resistance also decreases.

Referring back to FIG. 2C, the hump region 22 is where the greatest amount of power provided to the hull is lost to generating waves, and is thus unavailable to increase the speed of the hull. Because of this, conventional large vessels, such as commercial freighters, are designed to avoid the hump region 22 and cruise at a speed that generates a Froude number less than about 0.4. To increase the cruising speed of these vessels while remaining in the low Froude number region, the hulls of these vessels are lengthened.

For example, FIG. 3 is a side view of a conventional ship 36 having a hull length 38. The ship 36 is designed to cruise at a speed that generates a Froude number equal to about 0.4. If a greater cruising speed is desired, one can design the ship's hull to be longer such that the Froude number at the cruising speed remains equal to about 0.4. For example, if the length 38 is 200 feet, then the cruising speed that generates a Froude number equal to 0.4 is about 18.9 knots. If the length 38 is 400 feet, then the cruising speed that generates a Froude number equal to 0.4 is about 26.8 knots.

Unfortunately, because conventional large vessels are designed to cruise at speeds that generate a Froude number less than about 0.4, the effective speed limit for these vessels is the speed that generates a Froude number approximately 0.4. To exceed this speed limit, the vessel requires a substantial increase in power to overcome the wave resistance that occurs while moving at a speed that generates a Froude number greater than about 0.4 but less than about 0.5. Moreover, because the hulls of such vessels are lengthened to increase their cruising speed in the low Froude number region, the maximum wave-resistance that they experience at a Froude number approximately 0.5 will occur at a relatively high speed. Thus, the vessel would require a large amount of power (21*b* in FIG. 2B) to overcome the total resistance (19*b* in FIG. 2A) at the maximum-wave-resistance speed, and to power the vessel at a cruising speed that is in the high Froude number region (24 in FIG. 2C). Consequently, the size and weight of the vessel's propulsion system would significantly increase, and thus reduce the total payload of the vessel and increase fuel consumption.

Referring again to FIG. 2C, many boats have hulls that plane on the surface of the water while the boat cruises. These boats typically have a hull that extends continuously for the length of the boat and are provided with enough power to propel the boat through the hump region 22. In the high Froude number region 24, the boat's hull planes or develops lift from dynamic forces of the water. This planing effect lifts the boat, reducing the wetted surface area of the hull in contact with the water, and thus reducing viscous resistance. Additionally, this planing effect reduces the boat's displacement, which reduces wave resistance. Unfortunately, because the hull length of large, conventional planing vessels is long, the hump region 22 occurs at a high speed. This high speed generates a significant viscous resistance component of the total resistance, which causes the total resistance through the hump region 22 to be high. Thus, a large amount of power is required to propel the boat through the hump region to reach its cruising speed.

SUMMARY

In one aspect of the invention, a vessel that travels over the surface of a liquid has a liquid-plane greater than 1.0 meter$^2$/(metric ton)$^{2/3}$, and includes a hull having a total length and a plurality of hull portions each having a length that is less than the total length. Each hull portion displaces a volume of liquid whose weight, when combined with the weight of the volumes of liquid displaced by the other hull portions, equals the weight of the vessel. Each hull portion also protrudes above the liquid-line and includes a wetted area that does not contact the wetted areas of other hull portions when the boat accelerates through Froude numbers greater than 0.4. In addition, each hull portion includes a cross-sectional area having a perimeter defined by the edge of the wetted area and having an area defined by a plane that intersects the hull portion at the perimeter. The vessel's liquid-plane is the sum of each hull portion's cross-sectional area (in meters) divided by the cube root of the square of the weight (in metric tons) of the liquid displaced by the hull portions.

Because when the vessel accelerates toward a cruising speed the wetted area of each hull portion does not contact the wetted areas of the other hull portions, the vessel's hull experiences the maximum wave resistance at a lower speed than a long, single hull providing the same buoyancy. The vessel's hull also requires less power to overcome a total resistance at the maximum-wave-resistance speed than a long, single hull requires. Thus, for displacement vessels that displace a volume of liquid whose weight equals the weight of the vessel when cruising, the amount of power required to overcome the hump region and to cruise at a speed that generates a Froude number greater than 0.6 is often less than for conventional vessels having similar payload capacities. For planing vessels, the amount of power required to overcome the hump region and reach their cruising speed is often less than the power that conventional, single-hull planing vessels require.

DETAILED DESCRIPTION

Figure 4:
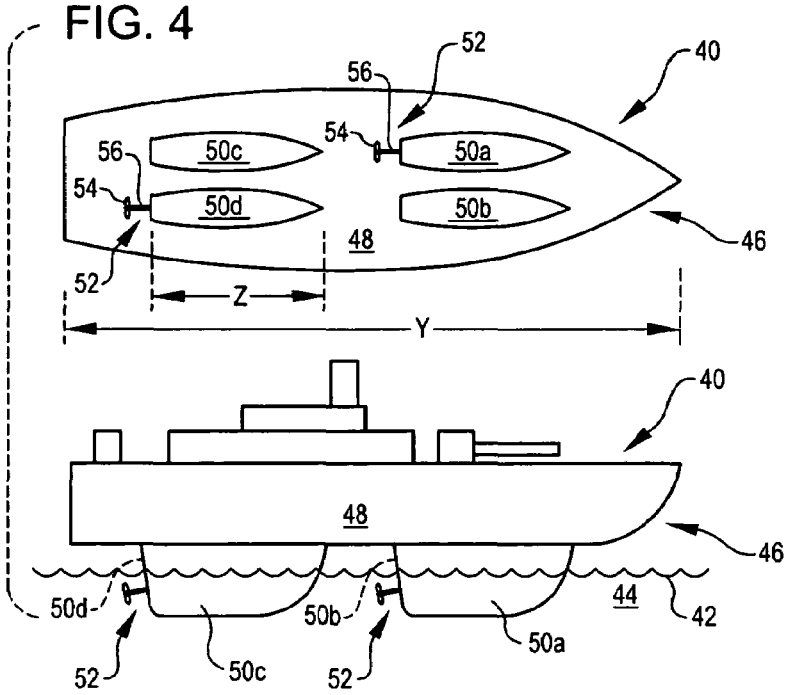
FIG. 4 is a plan view and a side view of a vessel having a plurality of hull portions according to an embodiment of the invention.

FIG. 4 is a plan view and a side view of a vessel 40 according to an embodiment of the invention. In the side view, the vessel 40 is shown traveling across the surface 42 of a liquid 44, such as water in an ocean or a lake. The vessel 40 may be large, like an ocean-going, commercial freighter, small, like a model boat one might operate on a pond, or somewhere in between. The vessel 40 has a liquid-plane greater than 1.0 meter$^2$/(metric ton)$^{2/3}$ (discussed in greater detail in conjunction with FIGS. 5 and 8–13), and when cruising may displace a volume of liquid whose weight equals the vessel's weight (discussed in greater detail in conjunction with FIG. 5) or may plane on the surface of the liquid (discussed in greater detail in conjunction with FIG. 10).

The vessel 40 includes a hull 46 having a frame 48, a length Y and a plurality of hull portions 50*a*–*d* (here four) each extending from the frame and each having a length Z that is less than Y. Each hull portion 50*a*–*d* extends into the water 44 to support the vessel 40 on the surface 42 of the liquid. Each part of the hull portions 50*a*–*d* that extends into the liquid 44 defines a wetted area (discussed in greater detail in conjunction with FIG. 5) that does not contact the other wetted areas as the vessel 40 travels across the surface 42. Thus, the speed that each hull portion 50*a*–*d* must reach to generate a Froude number greater than approximately 0.6 is often less than the speed that a single hull portion having a length Y, or multiple hull portions, each having a length Y, must reach to generate the same Froude number. Consequently, the vessel 40 can often more easily travel at a speed that generates a Froude number greater than approximately 0.6 to reduce wave resistance.

Because each of the hull portions 50*a*–*d* has a wetted area that does not contact the wetted areas of the other hull portions 50*a*–*d*, each hull portion generates its own wave (not shown) as the vessel 40 travels across the surface 42. Thus, the total wave resistance experienced by the vessel 40 is the sum of the respective wave resistances experienced by each of the hull portions 50*a*–*d*. As previously discussed, the wave resistance associated with each wave depends on the Froude number that the respective hull portion generates as it moves relative to the liquid. Because the Froude number is inversely proportional to the square of the product of the acceleration of gravity and hull length, the length Z, not Y, determines the speed at which each of the hull portions 50*a*–*d* generates a Froude number. Because the length Z is less than the length Y, the speed at which each of the hull portions 50*a*–*d* generate a Froude number greater than approximately 0.6 is often less than the speed at which a single hull portion having a length Y, or multiple hull portions, each having a length Y, must reach to generate the same Froude number. Furthermore, the speed at which each of the hull portions 50*a*–*d* experiences the maximum wave resistance (a Froude number of about 0.5) is less than the speed at which a single hull portion having a length Y, or multiple hull portions, each having a length Y, experiences the maximum wave resistance.

For example, assume a single hulled vessel has a hull length Y equal to 100 meters that extends the length of the vessel, and the vessel 40 has hull portions 50*a*–*d* each having a length Z equal to 20 meters. For the single-hulled vessel to generate a Froude number of 0.4, it must travel about 23.9 knots. For the vessel 40 to generate a Froude number of 0.4, it must travel about 10.9 knots, and to generate a Froude number of 0.8, it must travel about 21.9 knots.

Figure 1:
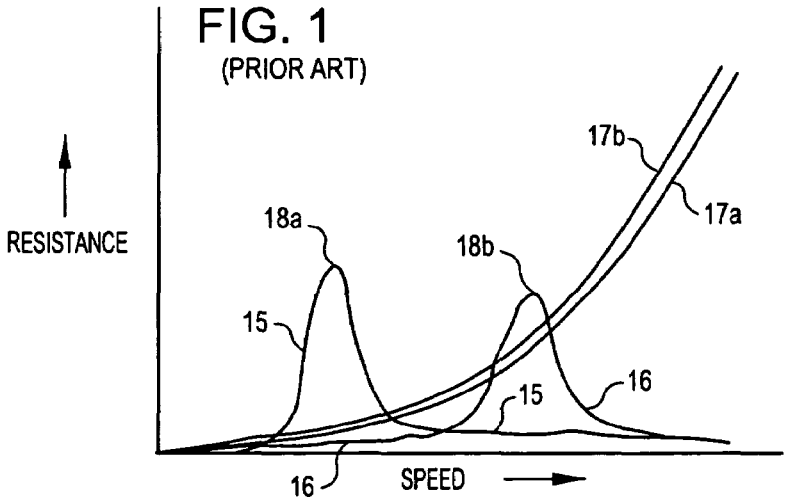
FIG. 1 (PRIOR ART)
FIG. 1 is a typical graph of wave resistance and viscous resistance verses speed for two similar hulls whose only significant difference is their length.

Thus, in the above example, the amount of power required to accelerate the vessel 40 through the hump region (e.g. 22 in FIG. 1) and toward a speed at which each of the hull portions 50*a*–*d* generates a Froude number greater than 0.6 is typically less than the amount of power required for a vessel having a single, long hull of length Y. And, the amount of power required to propel the vessel 40 at the speed at which each of the hull portions 50*a*–*d* generates a Froude number greater than 0.6 is typically less than the amount of power required for the vessel, having a single, long hull. Consequently, the vessel 40 can typically cruise at a speed that generates a Froude number greater than 0.6, a speed which is often faster than the cruising speed of a vessel having the same length but with a conventional, single hull. Furthermore, the vessel 40 can often consume less power accelerating through the hump region than a vessel of the same length having a conventional, single hull. In addition, because each of the hull portions 50*a–d* are operating above their hump-region speed, the total wave energy generated by the hull portions 50*a–d* is less than the wave energy generated by the hull 46 without the hull portions. Thus, the waves generated by the hull portions 50*a–d* may cause less damage to a shoreline when they wash ashore than the waves generated by the hull 46 without the hull portions.

Still referring to FIG. 4, the length Z of each hull portion can be any desired length that is shorter than the length Y of the frame 48. For example, in one embodiment each of the hull portions 50*a–d* has the same or substantially the same length. Thus, each of the hull portions 50*a–d* experiences the maximum wave resistance in the hump region at the same or substantially the same speed. In other embodiments, one or more of the hull portions 50*a–d* may have a length that is different than one or more of the other hull portions (shown in FIG. 6). Thus, the speed that each of the hull portions 50*a–d* experiences the maximum wave resistance will be different than the speed of at least one of the other hull portions 50*a–d*. This may be desirable to avoid having to simultaneously overcome the maximum wave resistance of each hull portions 50*a–d*.

Still referring to FIG. 4, the vessel also includes a propulsion system 52 to propel the vessel 40. For example, in one embodiment the propulsion system 52 includes a first motor (not shown) disposed in the hull portion 50*a*, and a second motor (not shown) disposed in the hull portion 50*d*. The motors may be conventional, diesel, reciprocating-piston engines, but may be any other conventional motors, such as rotary engines. The propulsion system 52 may also include a propeller 54 mounted to an output shaft 56 that extends into the liquid 40. To propel the vessel 40, the motor rotates the shaft 56, and thus the propeller 54.

With the ability to dispose portions of the propulsion system 52 in a forward hull portion 50*a*, the weight of the propulsion system 52 may be more evenly distributed in the hull 46. Furthermore, more space may be available to dispose additional motors, and thus increase the power capacity of the propulsion system 52, or to reduce the size of the motors for the same total power output.

Other embodiments are contemplated. For example the motor may be disposed in the frame 48 of the hull 46, not in any of the hull portions 50*a–d*. Or, a motor may be disposed in each of the hull portions 50*a–d*. This may be desirable to provide a substantially even distribution of the vessel's weight to enhance a performance characteristic of the vessel 40. Or, the vessel 40 may not include a motor to propel the boat across the liquid's surface, but may include a sail to harness the wind to propel the vessel 40. The vessel 40 may also include both a motor and a sail.

Figure 5A:
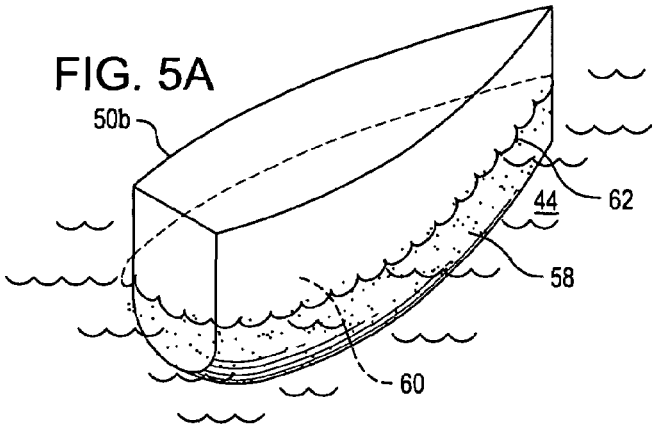
FIG. 5A is a perspective view of a hull portion in FIG. 4, according to an embodiment of the invention.
Figure 5B:
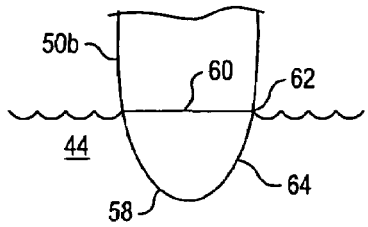
FIG. 5B is a rear view of the hull portion in FIG. 5A.

FIG. 5A is a perspective view of a hull portion 50*b* in FIG. 4, according to an embodiment of the invention. FIG. 5B is a rear view of the hull portion 50*b*. The hull portion 50*b* is similar to the other hull portions 50*a, c* and *d*, thus the discussion of the hull portion's wetted area, liquid volume displacement, and liquid-plane applies to the other hull portions 50*a, c* and *d*.

The hull portion 50*b* displaces a volume of liquid when the hull portion 50*b* moves relative to the liquid 44 at a speed that generates a Froude number greater than about 0.6. When the weight of the displaced liquid is combined with the weights of the liquid displaced by the other hull portions 50*a, c* and *d*, the combined weight equals the weight of the vessel 40. The displaced volume is the volume confined by the wetted area 58 and the cross-sectional area 60 of the hull portion at the liquid-line 62. The wetted area 58 is the surface 64 of the hull portion 50*b* that contacts the liquid 44. The cross-sectional area 60 is the area of a plane that intersects the hull portion 50*b* and has a perimeter defined by the edge of the wetted area 58.

The liquid-plane of the hull portion 50*b* indicates how much of the displaced volume is displaced at the surface of the liquid and is defined as:

$$\text{Liquid-plane} = \frac{A}{D^{2/3}}$$

where A=cross-sectional area 60 in meters, and D=total weight in metric tons of the displaced volume of liquid. As shown in the equation, if the displaced volume of liquid remains constant as the cross-sectional area 60 increases, then the liquid-plane increases.

Still referring to FIG. 5, the hull portion 50*b* has a large liquid-plane—at least 1.0 meter$^2$/(metric ton)$^{2/3}$ in one embodiment. For example, in one embodiment the hull portion 50*b* has a liquid-plane substantially equal to 3.0 meter$^2$/(metric ton)$^{2/3}$, and each of the other hull portions 50*a, c* and *d* (FIG. 4) has substantially the same liquid-plane. In other embodiments, the hull portion 50*b* may have a liquid-plane that is substantially different than one or more of the other hull portions 50*a, c* and *d*.

Other embodiments are contemplated. For example, as discussed in greater detail in conjunction with FIGS. 11, 12 and 13, the hull portion 50*b* may have a liquid-plane between two and nine meter$^2$/(metric ton)$^{2/3}$. Or, as discussed in greater detail in conjunction with FIG. 10, the hull portion 50*b* may have a liquid-plane substantially equal to 2.5 meter$^2$/(metric ton)$^{2/3}$. Or, as discussed in greater detail in conjunction with FIG. 14, the hull portion 50*b* may have a liquid-plane substantially equal to 3.0 meter$^2$/(metric ton)$^{2/3}$.

Figure 6:
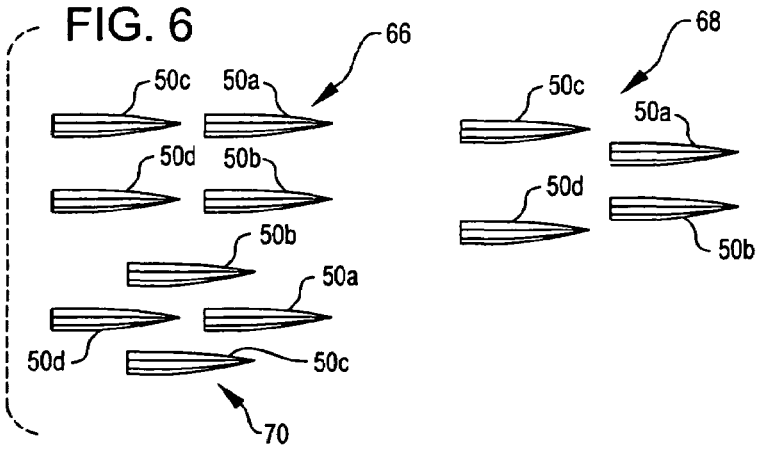
FIG. 6 is a plan view of hull portions arranged in different configurations according to embodiments of the invention.

FIG. 6 is a plan view of the hull portions 50*a–d* in FIG. 4 arranged in different configurations, according to embodiments of the invention. The distances between hull portions 50*a–d* typically do not substantially affect the Froude number that each hull portion generates. Likewise, the number of hull portions 50*a–d* typically does not substantially affect the Froude number that each of the hull portions 50*a–d* generates.

For example, in one embodiment the hull portions 50*a–d* are arranged to form a rectangular pattern 66. The distance between the hull portions 50*a* and 50*c* is substantially the same as the distance between the hull portions 50*b* and 50.*d*. The distance between the hull portions 50*a* and 50*b* is substantially the same as the distance between the hull portions 50*c* and 50*d*.

In another embodiment, the hull portions are arranged to form a trapezoidal pattern 68. The distance between the hull portions 50*a* and 50*c* is substantially the same as the distance between the hull portions 50*b* and 50*d*. But the distance between the hull portions 50*a* and 50*b* is less than the distance between the hull portions 50*c* and 50*d*.

In yet another embodiment, the hull portions 50*a–d* are arranged to form a diamond pattern 70. The distance from the hull portion 50*a* to either hull portion 50*b* or hull portion 50*c* is substantially the same. The distance from the hull portion 50*d* to either hull portion 50*b* or hull portion 50*c* is the same and equal to the distance from the hull portion 50*a* to the hull portion 50*b*.

Other embodiments are contemplated. For example, the vessel 40 (FIG. 4) may include more than four hull portions arranged to form a figure-8 pattern or an oval pattern, or any other pattern.

Figure 7:
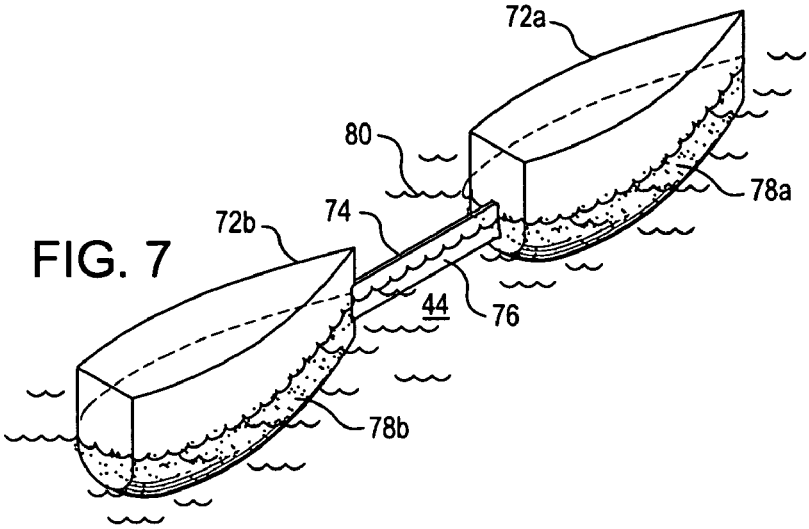
FIG. 7 is a perspective view of two hull portions joined with a connector portion, according to another embodiment of the invention.

FIG. 7 is a perspective view of two hull portions 72*a* and 72*b* joined with a connector portion 74, according to another embodiment of the invention. A part of the connector portion 74 may or may not extend into the liquid 44 and may include a wetted area 76 that couples the wetted areas 78*a* and 78*b* of each of the hull portions 72*a* and 72*b* together. However, the connector portion 74 is substantially thinner than each of the hull portions 72*a* and 72*b* therefore each of the hull portions 72*a* and 72*b* effectively generates its own wave (not shown) as it travels across the surface 80. Thus, when the hull portions 72*a* and 72*b* and connector portion 74 move relative to the liquid 44, the Froude number that each of the hull portions 72*a* and 72*b* generates at a speed depends on the length of each of the hull portions 72*a* and 72*b* not the combined lengths of the hull portions, or the combined lengths of the connector portion 74 and hull portions 72*a* and 72*b*.

The connector portion 74 may have any desired width that is in one embodiment as much as ¾ the maximum width of the thinner of the hull portions 72*a* and 72*b*. For example, in one embodiment the connector portion 74 is 1/15 the maximum width of the hull portion 72*a* and 3 feet long. The connector portion 74 is welded to the hull portions 72*a* and 72*b*, but may be mounted to each hull portion using other fastening techniques, such as adhesive or rivets.

Other embodiments are contemplated. For example, the connection portion 74 may be removable from one or both of the hull portions 72*a* and 72*b* or the connector portion 74 may not be removable from the one or both of the hull portions 72*a* and 72*b*. In such an embodiment, the connector portion 74 and one or both of the hull portions 72*a* and 72*b* may be formed from one piece of material. In another example, the connector portion 74 is submerged when the hull portions 72*a* and 72*b* move relative to the liquid 44 at their cruising speed. In another example, the connector portion 74 also provides buoyancy to help the hull portions 72*a* and 72*b* support a vessel (not shown) above the liquid 44.

Figure 8:
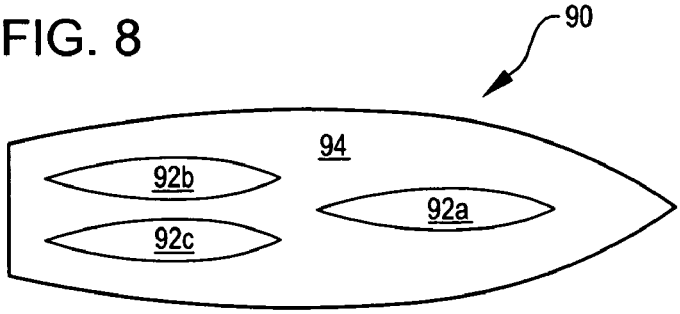
FIG. 8 is a plan view of another vessel having a plurality of hull portions according to another embodiment of the invention.

FIG. 8 is a plan view of another vessel 90 having a plurality of hull portions 92*a–c* according to another embodiment of the invention. The vessel 90 has three hull portions 92*a–c*, not four like the embodiment of the vessel 40 shown in FIG. 4, that protrude from a frame 99 of the vessel 90. Again, each hull portion 92*a–c* is analyzed individually with respect to a Froude number calculation, and thus the lengths of individual hull portions 92*a–c* determine the velocity of the vessel 90 required for the respective hull portions to operate at higher Froude numbers.

Figure 9:
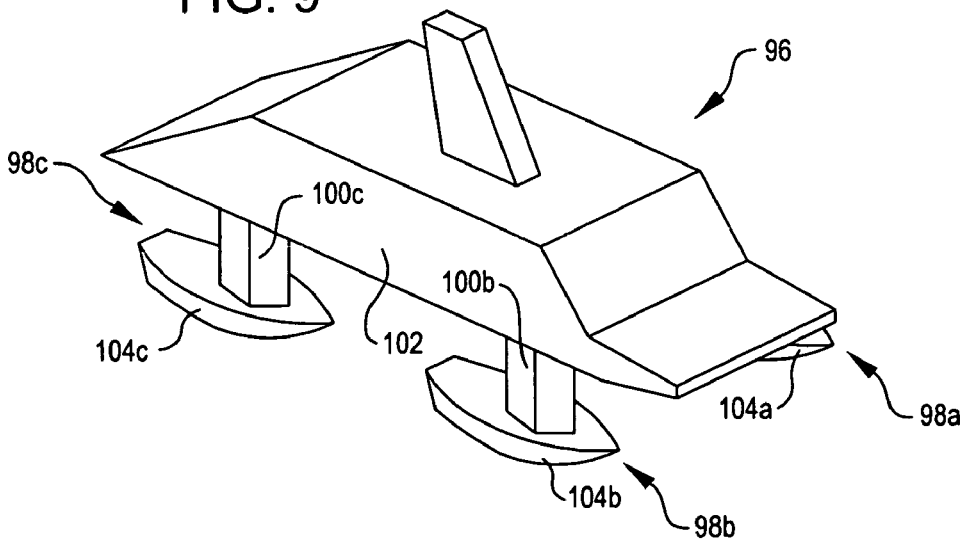
FIG. 9 is a perspective view of yet another vessel having a plurality of hull portions according to another embodiment of the invention.

FIG. 9 is a perspective view of another vessel 96 having hull portions 98*a–d* (only three shown) according to another embodiment of the invention. The depth that each of the hull portions 98*a–d* extends into the liquid (not shown) may be changed to change the liquid-plane of the hull portion. In this manner, the unique operational characteristics of a particular type of hull, such as a catamaran or a small liquid-plane twin hull (SWATH) can be obtained by adjusting the buoyancy of each of the hull portions 98*a–d*.

Each hull portion 98*a–d* includes a strut 100*a–d* (only two shown) that extends down from a main body 102 and attaches to a respective portion 104*a–d* (only three shown). The hull portions 98*a–d* collectively have an adjustable buoyancy such that the draft of the vessel 96 can be raised or lowered according to operating needs of the vessel 96, where the draft of the vessel is the depth to which the vessel is immersed in the liquid (not shown). A conventional ballasting system (not shown) can be used to adjust the buoyancy of the hull portions 98*a–d* and thereby control the operational characteristics of the hull portions 98*a–d*.

For example, in a catamaran mode, the buoyancy of the hull portions 98*a–d* are increased. Thus, each of the hull portions 98*a–d* behaves as if it were its own independent hull with respect to wave drag Cw as discussed above. In this mode, when the vessel 96 cruises, each of the hull portions 98*a–d* generates a Froude number greater than about 0.6. In the SWATH mode, the buoyancy of the hull portions 98*a–d* are decreased such that the portions 104*a–d* are completely submerged in liquid and portions of the struts 100*a–d* are also submerged. As a result, the liquid-planes of the hull portions, 98*a–d* are reduced below 1.0 to improve the vessel's sea-keeping.

Other operational modes are discussed in greater detail in U.S. patent application Ser. No. 10/712,786, entitled VESSEL WITH A MULTI-MODE HULL, which was filed on Nov. 12, 2003, assigned to the Lockheed Missiles and Space Co. and which is incorporated by reference.

Other embodiments are contemplated. For example, the vessel 96 may include any number of struts 100*a–d*, each strut attached to one or more pontoons 104*a–d*. For example, a vessel (not shown) may have a port side strut and a starboard side strut, each strut connected to six individual pontoons to provide buoyancy. In another example, a vessel (also not shown) may have a port side pontoon and a starboard side pontoon, each pontoon attached to the main body 102 via a plurality of struts. In either example, the struts may be as long as the ship itself or shorter. Likewise, the pontoons may all have the same lengths or each may have a different length, and may be arranged in various patterns as described above with respect to FIG. 6.

Figure 10:
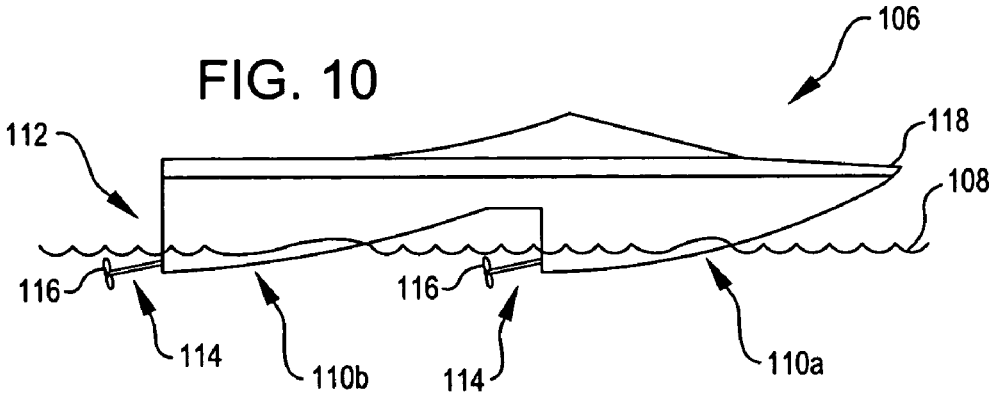
FIG. 10 is a side view of a planning vessel having a plurality of hull portions according to an embodiment of the invention.

FIG. 10 is a side view of a vessel 106 planing on a liquid's surface 108 and having a plurality of hull portions 110*a* and 110*b*, according to an embodiment of the invention. The hull portions 110*a* and 110*b* each have a length that is less than the length of the vessel's hull 112. Thus, the hull portions 110*a* and 110*b* reduce the speed at which the hull 112 generates a Froude number substantially equal to 0.5 relative to a vessel having a single hull extending the length of the vessel 106. The hull portions 110*a* and 110*b* also reduce the maximum total resistance that the vessel 106 must overcome to plane on the liquid's surface 108 at its cruising speed.

Figure 2A:
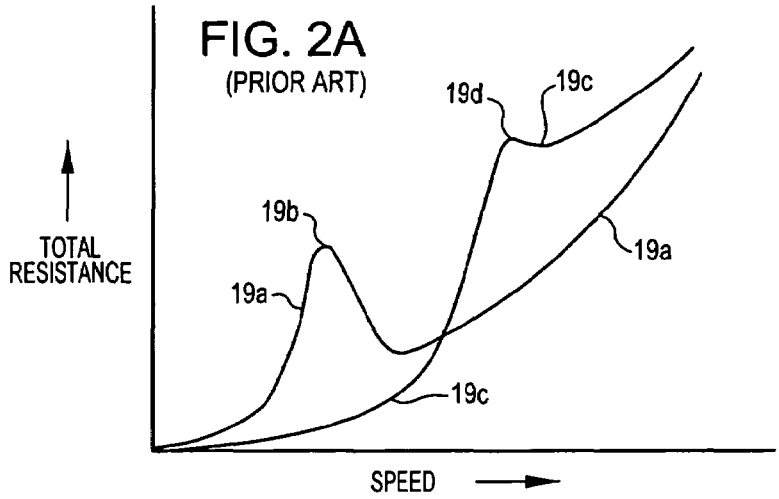
FIG. 2A (PRIOR ART)
FIG. 2A is a typical graph of total resistance verses speed for the two similar hulls referenced in FIG. 1.
Figure 2B:
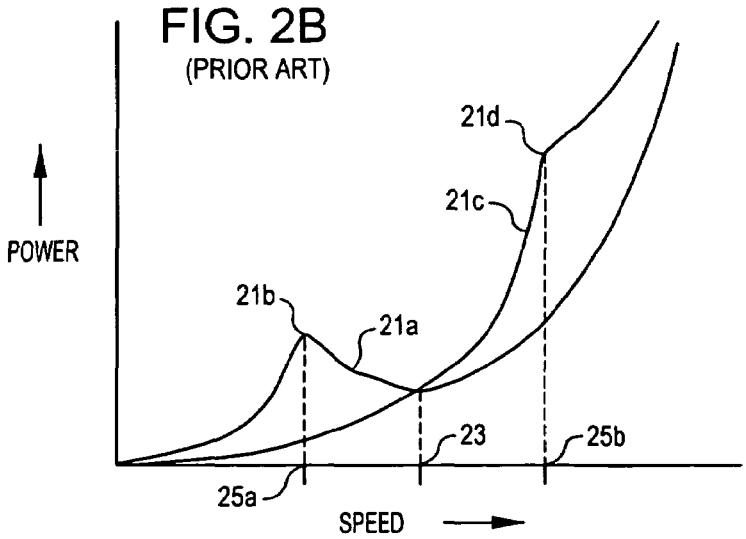
FIG. 2B (PRIOR ART)
FIG. 2B is a typical graph of power verses speed for the two similar hulls referenced in FIG. 1.
Figure 2C:
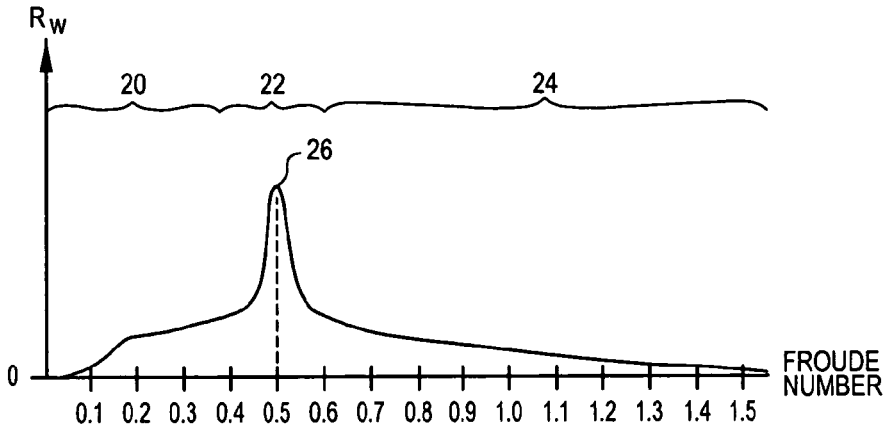
FIG. 2C (PRIOR ART)
FIG. 2C is a typical graph of wave resistance versus Froude number for a hull.
Figure 2D:
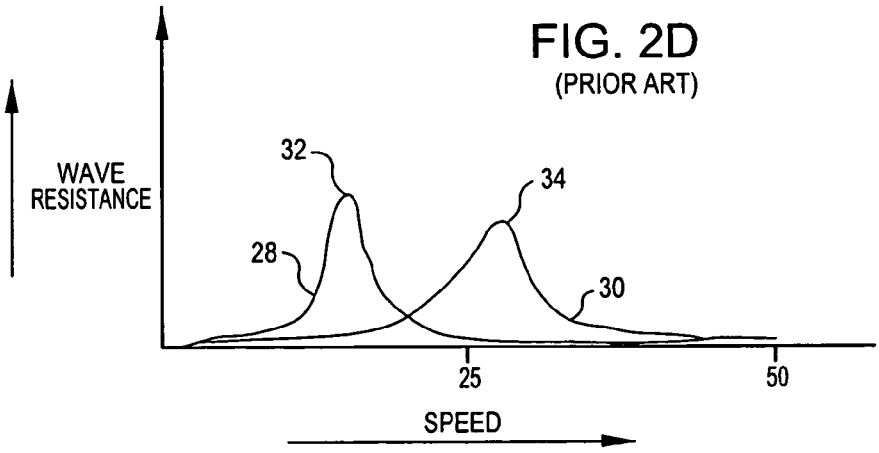
FIG. 2D (PRIOR ART)
FIG. 2D is a typical graph of wave resistance versus speed for two similar hulls whose only significant difference is their length.
Figure 3:
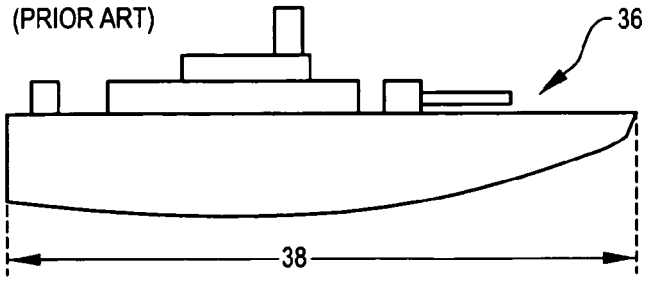
FIG. 3 (PRIOR ART)
FIG. 3 is a side view of a conventional vessel having a long hull.

As previously discussed, when a planing vessel cruises, its hull plane's on the surface of the liquid and the speed of its hull generates a Froude number greater than about 0.6. But, as a planing vessel accelerates toward its cruising speed, its hull generates Froude numbers throughout the hump region (e.g. 22 in FIG. 2C). Thus, before a planing vessel can plane on a liquid's surface, the vessel typically must overcome a maximum total resistance (e.g. 19*b* in FIG. 2A).

By reducing the speed at which the maximum wave resistance occurs, the vessel 106 can plane at a slower speed. Thus, the vessel 106 can be longer than most conventional planing vessels and still plane at speeds that most conventional planing vessels plane at. Alternatively, the vessel 106 can be the same length as most conventional planing vessels and use less power, and thus consume less fuel, to accelerate through the hump region to reach its cruising speed, and to maintain its cruising speed while planing.

Still referring to FIG. 10, the vessel 106 includes a propulsion system 114 and two hull portions 100*a* and 100*b*, but may include more than two hull portions. Each of the hull portions 110*a* and 110*b* includes a wetted area (omitted for clarity in FIG. 10), and houses a motor (not shown) that powers a propeller 116. When the vessel 106 moves relative to the liquid and each of the hull portions 110*a* and 110*b* generates a Froude number between approximately 0.2 and 0.8 (not shown), the wetted area of each hull portion does not contact the other's wetted area. Thus, each of the hull portions 110*a* and 110*b* generates its own wave (not shown), and the wave resistance that the vessel 106 experiences is determined by the Froude number that each hull portion generates. When the vessel 106 planes on the surface 108 (shown in FIG. 10), the wetted area of each of the hull portions 110*a* and 110*b* remains isolated from the other's wetted area.

Because each of the hull portions 110*a* and 110*b* remains in contact with the surface 108 of the liquid as the vessel planes, the multiple hull portions provide additional benefits. For example, the combined area of the wetted surfaces may be greater than the wetted area of a planing single hull. Thus, the payload of the vessel 106 can be greater than the payload of a planning single hull. Another example includes having one of the wetted areas forward of the other, and thus supporting the vessel 106 at two locations separated by a significant distance. This may locate the center of support further forward than the location of the center for a planing single hull, and provides a restoring moment when the nose 118 of the vessel 106 pitches in rough liquid. Thus, the vessel's center of gravity may be located further forward, which can further help the restoring moment improve the vessel's stability and ride in rough water.

Figure 11:
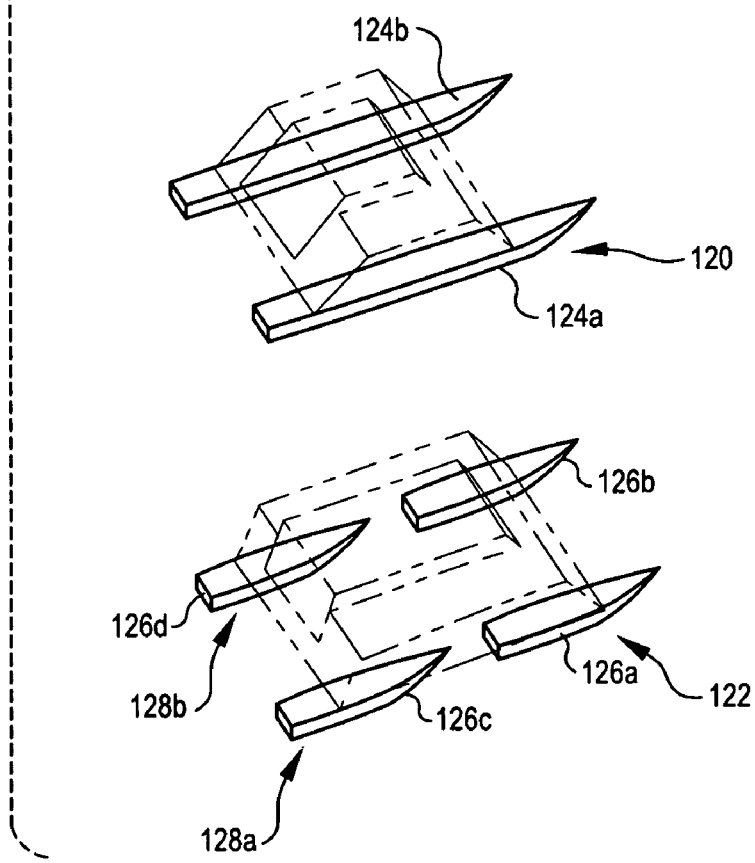
FIG. 11 is a perspective view of a conventional catamaran hull, and a catamaran hull according to an embodiment of the invention.

FIG. 11 is a perspective view of a conventional catamaran hull 120, and a catamaran hull 122 according to an embodiment of the invention. The conventional catamaran hull 120 includes two long and narrow hull parts 124*a* and *b*, and the catamaran hull 122 includes multiple hull portions 126*a–d*. The multiple hull portions 126*a–d* allow the catamaran hull 122, and thus the catamaran (shown in phantom) to more easily travel at a speed that generates a Froude number greater than about 0.6 to reduce wave resistance.

The catamaran hull 122 includes two hull sections 128*a* and 128*b* that each includes multiple hull portions. For example, in one embodiment the hull section 128*a* includes two hull portions 126*a* and 126*c*, and the other hull section 128*b* includes two hull portions 126*b* and 126*d*. Each of the hull portions 126*a–d* displaces substantially the same volume of liquid. Additionally, each of the hull portions 126*a–d* may extend deeper into the water than the hull parts 124*a* and 124*b*, or may be wider than the width of each of the narrow hull parts 124*a* and 124*b* of the conventional catamaran hull 120, to substantially displace the same volume of liquid as the sections 124*a* and 124*b* displace. With hull portions 126*a–c* that are wider than the sections 124*a* and 124*b*, one or more of the hull portions 126*a–d* can easily house a conventional standard-sized propulsion system, which often will not fit in the narrower sections 124*a* and 124*b* without significant modifications.

Other embodiments are contemplated. For example, one or both hull sections 128*a* and 128*b* may include more than two hull portions. Or, one or both hull sections 128*a* and 128*b* may include a hull portion that planes on the surface of the liquid when the catamaran cruises, and another hull portion that does not.

Figure 12:
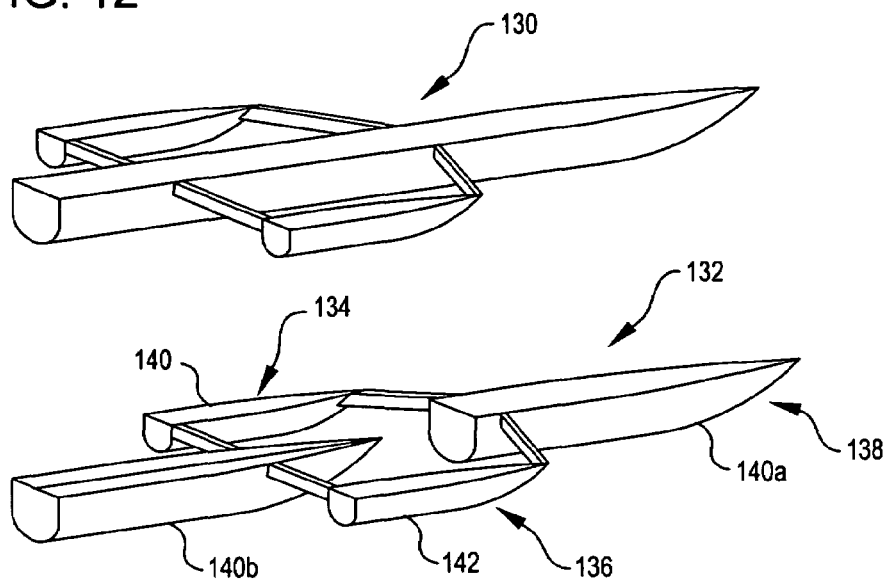
FIG. 12 is a perspective view of a conventional trimaran hull, and a trimaran hull according to an embodiment of the invention.

FIG. 12 is a perspective view of a conventional trimaran hull 130 and a trimaran hull 132 according to an embodiment of the invention. The trimaran hull 132 is similar to the catamaran hull 122 in FIG. 11 except the trimaran hull 132 includes three hull sections. The hull 132 includes a first hull section 134, a second hull section 136, and a main hull section 138 that includes multiple hull portions 140*a* and 140*b* to allow the trimaran hull 132, to cruise at a greater Froude number to reduce wave resistance.

For example in one embodiment the main hull section 138 includes two hull portions 140*a* and 140*b* that are each connected to the first and second hull sections 134 and 136. The first and second hull sections 134 and 136 each include a single hull portion 140 and 142. In other embodiments, the main hull section 138 may include more than two hull sections. Furthermore, the first section 134, the second section 136, or both may include multiple hull portions.

Figure 13:
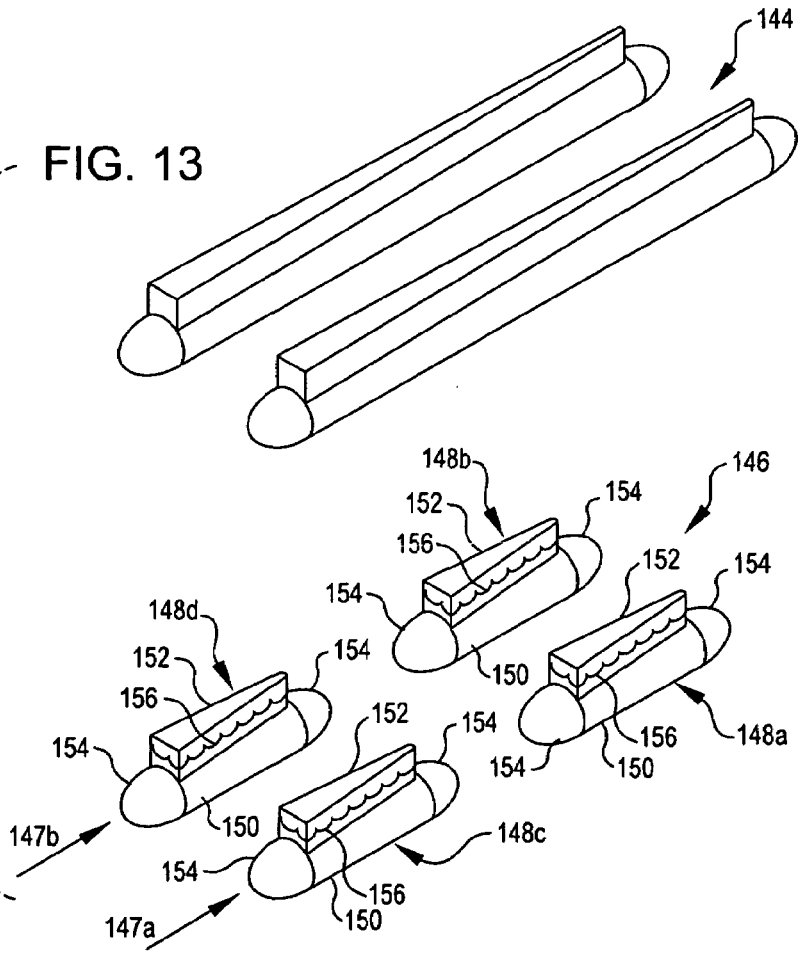
FIG. 13 is a perspective view of a conventional semi-SWATH hull, and a semi-SWATH hull according to an embodiment of the invention.

FIG. 13 is a perspective view of a conventional semi-SWATH hull 144 and a semi-SWATH hull 146 according to an embodiment of the invention. The semi-SWATH hull 146 is similar to the catamaran hull 122 in FIG. 11 except the hull 146 has a liquid-plane between one and two meter$^2$/(metric ton)$^{2/3}$, which is typically less than the catamaran's liquid-plane. The semi-SWATH hull 146 includes two hull sections 147*a* and *b*, each having multiple hull portions 148*a–d* to allow the semi-SWATH hull 146, and thus the semi-SWATH vessel (not shown), to more easily travel at a speed that generates a Froude number greater than about 0.6 to reduce wave resistance.

Each of the hull portions 148*a–d* may be shaped as desired to provide the hull 146 a liquid-plane between one and two. For example, in one embodiment each of the hull portions 148*a–d* includes a pontoon 150, and a strut 152 to connect the pontoon 150 to the vessel. Each pontoon 150 is cylindrically shaped and includes a pointed nose 154 to reduce the drag generated by the form of the pontoon 150, and the strut 152 is triangularly shaped (when viewed from above). When the semi-SWATH vessel travels over the liquid surface (not shown), each pontoon 150 is submerged and a part of strut 152 is submerged to the liquid line 156. Thus, each hull portion 148*a–d* has a triangular shaped cross-sectional area at the liquid line 156.

Other embodiments are contemplated. For example, the cross-sectional area at the liquid line 156 may have a rectangular or elliptical shape, or any other desired shape. In addition, one or both of the hull sections 147*a* and *b* may include a hull portion that has a liquid-plane less than one meter$^2$/(metric ton)$^{2/3}$ and another hull portion that has a liquid-plane greater than one such that the resulting liquid-plane of the hull section is greater than one meter$^2$/(metric ton)$^{2/3}$.

Figure 14:
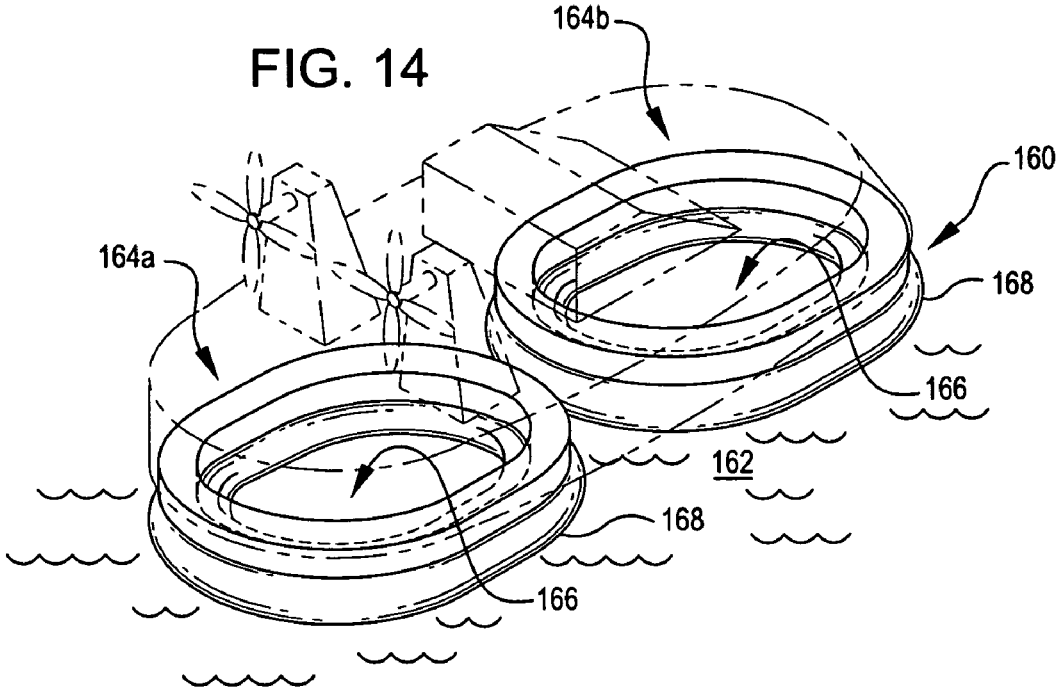
FIG. 14 is a perspective view of an air-cushion hull according to an embodiment of the invention.

FIG. 14 is a perspective view of an air-cushion hull 160 according to an embodiment of the invention. The air-cushion hull 160 generates and confines a column of air (not shown) to support an air-cushion vessel (shown in dashed lines) above the liquid surface 162, like a hovercraft. When the vessel sits on the column of air, a portion of the column extends into the liquid similar to a boat's hull. The air-cushion hull 160 includes multiple hull portions 164*a* and 164*b* that generate and confine multiple columns of air to support the vessel. Compared to an air-cushion hull having a single column of air, the multiple columns of air of the hull

160 allow the vessel to more easily travel at a speed that generates a Froude number greater than approximately 0.6 to reduce wave resistance.

For example, in one embodiment the air-cushion hull 160 includes two hull portions 164*a* and 164*b*. Each of the hull portions 164*a* and 164*b* includes an interior 166 into which air is pumped using conventional equipment (not shown), such as a fan or a compressor, and a skirt 168 to keep the air from quickly escaping out of the interior 166. The skirt 168 is a conventional skirt that is used in hovercrafts and is flexible to allow surface irregularities such as floating logs, to enter and then exit the interior 166 without causing a significant amount of air to quickly escape. Thus, each of the hull portions 164*a* and 164*b* can support the vessel as each hull portion moves over surface irregularities.

Other embodiments are contemplated. For example, the air-cushion hull 160 may include more than two hull portions arranged in any desired pattern as previously discussed in conjunction with FIG. 6.

The preceding discussion is presented to enable a person skilled in the art to make and use the invention. The general principles described herein may be applied to embodiments and applications other than those detailed above without departing from the spirit and scope of the present invention. The present invention is not intended to be limited to the embodiments shown, but is to be accorded the widest scope consistent with the principles and features disclosed or suggested herein

We claim:

1. A vessel comprising:

a hull having a total length and a plurality of hull portions, each hull portion operable to displace a volume of liquid whose weight, when combined with the weight of the volumes of liquid displaced by the other hull portions, equals the weight of the boat, and each hull portion including:

a length that is less than the total length of the hull, a wetted area that does not contact the wetted areas of other hull portions when the boat accelerates through Froude numbers between 0.4 and 0.6, and a cross-sectional area having a perimeter defined by the edge of the wetted area and having an area defined by a plane that intersects the hull portion at the perimeter, wherein the sum of each hull portion's cross-sectional area in meters divided by the cube root of the square of the weight in metric tons of the liquid displaced by the hull portions is at least one, and each hull portion protrudes above the liquid's surface when the boat accelerates through the Froude numbers between 0.4 and 0.6 toward a cruising speed relative to the liquid.

2. The vessel of claim 1 wherein the hull also includes a connector portion operable to join two hull portions together and includes a wetted area that contacts each wetted area of the joined hull portions.

3. The vessel of claim 1 wherein a hull portion is operable to plane when the vessel moves at the cruising speed.

4. The vessel of claim 1 wherein a hull portion is operable to displace substantially the same volume of liquid when the vessel moves at the cruising speed and when the vessel does not.

5. The vessel of claim 1 wherein:

a first hull portion is operable to plane when the boat moves at the cruising speed, and a second hull portion is operable to displace substantially the same volume of liquid when the vessel moves at the cruising speed and when the vessel does not.

6. The vessel of claim 1 wherein a hull portion is operable to generate a cushion of air to exert pressure on a surface of the liquid to support the vessel over the liquid.

7. The vessel of claim 1 wherein the Froude number is greater than 0.6 when the vessel moves at the cruising speed.

8. The vessel of claim 1 further comprising a motor disposed in a hull portion and operable to move the vessel at its cruising speed.

9. The vessel of claim 1 further comprising a first motor and a second motor, each operable to move the vessel, and when combined are operable to move the vessel at its cruising speed, wherein the first motor is disposed in a first hull portion, and a second motor is disposed in a second hull portion.

10. The vessel of claim 1 further comprising a sail operable to move the vessel at the cruising speed.

11. The vessel of claim 1 wherein the sum of each hull portion's cross-sectional area in meters divided by the cube root of the square of the weight in metric tons of the vessel is substantially two.

12. The vessel of claim 1 wherein the sum of each hull portion's cross-sectional area in meters divided by the cube root of the square of the weight in metric tons of the liquid displaced by the hull portions is between two and nine.

13. The vessel of claim 1 wherein:

the cross-sectional area in meters of a first hull portion divided by the cube root of the square of the weight in metric tons of the liquid displaced by the first hull portion is less than one, and the cross-sectional area in meters of a second hull portion divided by the cube root of the square of the weight in metric tons of the liquid displaced by the second hull portion is greater than one.

14. The vessel of claim 1 wherein the hull includes two hull portions aligned fore and aft relative to the hull.

15. The vessel of claim 1 wherein the hull includes a first hull portion, a second hull portion aft of the first hull portion relative to the hull, and a third hull portion beside the second hull portion and aft of the first hull portion relative to the hull.

16. The vessel of claim 1 wherein the plurality of hull portions includes a first hull portion having a first length, and a second hull portion having a second length that is not equal to the first length.

17. The vessel of claim 1 wherein the hull includes:

at least three hull portions, a first hull section having at least two hull portions, and a second hull section located beside the first hull section, and having the remaining one or more hull portions.

18. The vessel of claim 17 wherein the hull portions of the first hull section are aligned fore and aft relative to the hull section.

19. The vessel of claim 1 wherein the hull includes:

at least four hull portions, a first hull section having at least two hull portions, and a second hull section located beside the first hull section, and having at least two hull portions.

20. The vessel of claim 19 wherein the hull portions of the first and second hull sections are aligned fore and aft relative to their respective hull section.

21. The vessel of claim 1 wherein the hull includes:

a first hull section having at least one hull portion, a second hull section having at least one other hull portion, and a main hull section located between and beside the first and second hull sections, and having at least two hull portions.

22. The vessel of claim 21 wherein the at least two hull portions included in the main hull section are aligned fore and aft relative to the main hull section.

23. A method for traversing a liquid in a vessel that includes a hull having a length, the method comprising:

projecting a plurality of hull portions of the hull into the liquid to buoy the vessel, each hull portion including:

a length that is less than the total length of the hull, a wetted area that does not contact the wetted areas of other hull portions when the vessel accelerates through Froude numbers between 0.4 and 0.6, and a cross-sectional area having a perimeter defined by the edge of the wetted area and having an area defined by a plane that intersects the hull portion at the perimeter, wherein the sum of each hull portion's cross-sectional area in meters divided by the cube root of the square of the weight in metric tons of the liquid displaced by the hull portions is at least one, and a fraction of each hull portion lies above the liquid's surface; and accelerating the vessel toward a cruising speed, relative to the liquid, through the Froude numbers between 0.4 and 0.6.

24. The method of claim 23 further comprising:

joining a connector portion to two hull portions, and projecting the connector portion of the hull into the liquid, wherein the connector portion includes a wetted area that contacts each wetted area of the joined hull portions.

25. The method of claim 23 further comprising planing a hull portion when the vessel moves at its cruising speed.

26. The method of claim 23 further comprising displacing, with a hull portion, substantially the same volume of liquid when the vessel moves at its cruising speed and when the vessel does not.

27. The method of claim 23 further comprising forcing air, with a hull portion, toward the liquid's surface to exert pressure on the surface and support the vessel over the liquid.

28. The method of claim 23 wherein the Froude number is greater than 0.6 as the vessel moves at its cruising speed.

29. The method of claim 23 wherein accelerating the vessel includes generating power with a motor.

30. The method of claim 23 wherein accelerating the vessel includes exerting pressure on a sail.

* * * * *